US008590498B2

(12) United States Patent
Busse et al.

(10) Patent No.: US 8,590,498 B2
(45) Date of Patent: Nov. 26, 2013

(54) CAMSHAFT ADJUSTMENT DEVICE FOR AN INTERNAL COMBUSTION ENGINE

(75) Inventors: Michael Busse, Herzogenaurach (DE); Lutz Witthoeft, Aurachtal (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 436 days.

(21) Appl. No.: 13/057,636

(22) PCT Filed: Jul. 7, 2009

(86) PCT No.: PCT/EP2009/058626

§ 371 (c)(1),
(2), (4) Date: Mar. 23, 2011

(87) PCT Pub. No.: WO2010/015474

PCT Pub. Date: Feb. 11, 2010

(65) Prior Publication Data

US 2011/0168113 A1 Jul. 14, 2011

(30) Foreign Application Priority Data

Aug. 7, 2008 (DE) ..... 10 2008 036 876

(51) Int. Cl.
*F01L 1/34* (2006.01)

(52) U.S. Cl.
USPC ..... 123/90.17

(58) Field of Classification Search
USPC ..... 123/90.17
See application file for complete search history.

(56) References Cited

U.S. PATENT DOCUMENTS 5,615,648 A 4/1997 Ruoff
5,699,714 A * 12/1997 Jung et al. ..... 91/439
6,553,951 B2 4/2003 Ogawa
7,845,321 B2 * 12/2010 Kobaishi ..... 123/90.17
2002/0088413 A1 * 7/2002 Smith et al. ..... 123/90.15
2004/0182344 A1 * 9/2004 Simpson et al. ..... 123/90.17
2005/0066923 A1 * 3/2005 Yaoko et al. ..... 123/90.17
2005/0103294 A1 * 5/2005 Heinze et al. ..... 123/90.17
2005/0103297 A1 * 5/2005 Simpson ..... 123/90.17
2005/0257762 A1 * 11/2005 Sawada ..... 123/90.17
2006/0213471 A1 * 9/2006 Ogawa ..... 123/90.17
2007/0266976 A1 * 11/2007 Nagashima ..... 123/90.17
2008/0060471 A1 * 3/2008 Takahashi et al. ..... 74/568 R
2008/0066572 A1 * 3/2008 Takahashi et al. ..... 74/568 R
2008/0264364 A1 * 10/2008 Zhou ..... 123/90.17

FOREIGN PATENT DOCUMENTS

CN 1500973 A 6/2004
DE 42 10 580 A1 10/1993

(Continued)

*Primary Examiner* — Kenneth Bomberg
*Assistant Examiner* — Jorge Leon, Jr.
(74) *Attorney, Agent, or Firm* — Lucas & Mercanti, LLP

(57) ABSTRACT

A device for variable adjustment of the timing of gas exchange valves of an internal combustion engine, which has a hydraulic phase shifting device, a camshaft and a pressurizing medium distributor. The phase shifting device can come into drive linkage with a crankshaft and is rigidly connected to the camshaft. A phase position of the camshaft relative to the crankshaft can be variably adjusted by the phase shifting device. The interior of the camshaft has a cavity that communicates with one or more camshaft bearings which are separate from a rotating pressurizing medium conveyor. The pressurizing medium distributor is disposed in a receiving area of the camshaft. The camshaft has an opening in the area of the pressurizing medium distributor, which communicates with the interior of the camshaft and the pressurizing medium conveyor. A pressurizing medium path is inside the camshaft, which communicates the opening and hydraulic phase shift device.

4 Claims, 2 Drawing Sheets

(56) References Cited

FOREIGN PATENT DOCUMENTS

| | | | |
|---|---|---|---|
| DE | 101 03 876 | A1 | 9/2001 |
| DE | 10 2005 023 056 | A1 | 12/2005 |
| EP | 0 924 393 | A2 | 6/1999 |
| EP | 1 371 819 | A2 | 12/2003 |
| JP | 11 013430 | A | 1/1999 |
| JP | 2007 138725 | A | 6/2007 |

* cited by examiner

CAMSHAFT ADJUSTMENT DEVICE FOR AN INTERNAL COMBUSTION ENGINE

This application is a 371 of PCT/EP2009/058626 filed Jul. 7, 2009, which in turn claims the priority of DE 10 2008 036 876.8 filed Aug. 7, 2008, the priority of these applications is hereby claimed and these applications are incorporated by reference herein.

FIELD OF THE INVENTION

The invention relates to a camshaft adjustment device with a driving wheel and an output part arranged rotatably relative thereto. The driving wheel and output part are operatively connected via at least one pressure space which can be acted upon by pressure medium, and at least one regulating device is provided for regulating the supply of pressure medium to the pressure space and the removal of pressure medium from the pressure space. For the supply of pressure medium, at least one pressure medium inflow connection is formed between the regulating device and a pressure medium supply device.

BACKGROUND OF THE INVENTION

A camshaft adjustment device of this type is known from DE 101 03 876 A1/U.S. Pat. No. 6,553,951 B2 and US 2006/0213471 A1. A housing component which can be driven by an internal combustion engine and a rotor component which is connected in a rotationally fixed manner to a camshaft of the engine are arranged there rotatably relative to each other. In order to set a relative phase rotational angle between the rotor component and housing component, the two components are operatively connected via a plurality of pressure spaces divided in each case by a blade part, which is connected in a rotationally fixed manner to the rotor component, into two pressure chambers which can be acted upon by pressure medium and operate counter to each other. The pressure chambers are acted upon by pressure medium via a pressure medium connection between the pressure chambers and a pressure medium pump which conveys pressure medium from a pressure medium reservoir. The supply of pressure medium to the pressure chambers and the removal of pressure medium from the pressure chambers is regulated via a control valve arranged in the pressure medium connection. In order to supply the pressure medium, the control valve is connected to the pressure medium pump and the pressure medium reservoir via a pressure medium inflow line.

Upon adjustment of the relative phase rotational angle between the rotor component and the housing component, a pressure difference arises between the pressure medium pressures prevailing in each case in the pressure chambers operating counter to each other. As a result, the blade parts are not hydraulically clamped in the pressure spaces and execute swinging movements corresponding to the alternating torques acting on the camshaft. When the blade parts swing back counter to the adjustment direction, excess pressure may occur in the pressure chambers which are to be filled. If the excess pressure exceeds the pressure medium preliminary pressure prevailing in the pressure medium inflow connection, the excess pressure may continue via the pressure medium connection to the control valve and via the internal connections in the control valve into the pressure medium inflow line between the control valve and pressure medium pump or pressure medium reservoir. In order to prevent the pressure medium from flowing back in the direction of the pressure medium pump or of the pressure medium reservoir, a nonreturn valve is arranged in the pressure medium inflow line.

A disadvantage in this configuration is the fact that, in an operating state with a higher pressure medium pressure prevailing in the pressure medium system, the nonreturn valve, when acted upon by pressure medium in the transmitting direction, generates a large flow resistance in the pressure medium inflow line, the flow resistance leading to the supply of pressure medium being constricted and thereby leading to the adjustment dynamics of the camshaft adjustment device deteriorating.

In US 2006/0213471 A1, a controllable check valve which is connected in parallel to a nonreturn valve in a bypass and is opened or closed depending on the temperature of the pressure medium is provided in the pressure medium inflow connection. At low pressure medium temperatures and high viscosity of the pressure medium, the check valve is opened. As a result, the pressure medium flows through the open check valve via the bypass having a lower flow resistance. If the pressure medium temperature is greater than a predetermined threshold value at which the viscosity of the pressure medium is low, the check valve is closed, as a result of which the bypass is blocked and the pressure medium is guided via the nonreturn valve.

A disadvantage of this embodiment is the fact that additional control means are required for the temperature-controlled opening and closing of the check valve, said control means increasing the outlay on production.

Another disadvantage of this arrangement is the fact that at a high pressure medium temperature and high pressure medium preliminary pressure, the check valve and the bypass are closed in a temperature-controlled manner. As a result, when the engine is operated at high speed, pressure medium is supplied via the nonreturn valve with high flow resistance and constricted throughflow of the pressure medium, thus resulting in a considerable deterioration in the dynamics of the adjustment operation.

In addition, upon action of pressure medium in an operating state having a low pressure medium temperature with the check valve open, an excess pressure caused by the operation to occur in the pressure chambers can continue via the open bypass and cause the pressure medium to flow back in the direction of the pressure medium pump or in the direction of the pressure medium reservoir, with the consequence likewise of a considerable deterioration in the adjustment dynamics.

SUMMARY OF THE INVENTION

The invention is therefore based on the object of providing a camshaft adjustment device of the abovementioned type which avoids the abovementioned disadvantages.

According to the invention, by means of the at least two nonreturn valves which are connected parallel to each other in a pressure medium inflow connection between a regulating device and a pressure medium supply device, flow of a pressure medium back out of the pressure medium inflow connection into the pressure medium pump or the pressure medium reservoir can be reliably avoided in all operating states firstly by means of blocking which is dependent on the pressure medium pressure (differential pressure) prevailing in each case upstream of the nonreturn valves in the pressure medium inflow connection.

Secondly, flow of the pressure medium back out of the pressure medium inflow connection into the pressure medium pump or the pressure medium reservoir can be reliably avoided by opening one nonreturn valve or both nonreturn valves. The opening of one or both nonreturn valves is dependent on the preliminary pressure (differential pressure) of the pressure medium upstream of the nonreturn valve in the transmitting direction in the pressure medium inflow connection. The supply of pressure medium can be guided in the pressure medium inflow connection via a nonreturn valve with a small transmission cross section or via both nonreturn valves, which are connected in parallel, simultaneously with an increased transmission cross section.

In this manner, in particular in operating states in which there is sufficient pressure medium pressure in the pressure medium system for rapid adjustment of the camshaft adjustment device, for example during high-speed operation in the hot or in the cold state of the engine, adjustment speed of the camshaft adjustment device, said adjustment speed being increased in comparison to the prior art, can be achieved by simultaneous opening of both nonreturn valves in parallel operation.

Since, furthermore the pressure-dependent opening and closing of the nonreturn valves take place automatically, costly control means are avoided at the same time.

In a preferred refinement of the invention, the first and second nonreturn valves have different opening pressures, wherein the opening pressure is to be understood as meaning in each case the pressure difference, which is required for opening the nonreturn valve, between the pressure medium pressure upstream and downstream of the nonreturn valve in the pressure medium inflow connection (differential pressure). If the first nonreturn valve is designed with a low opening pressure and the second nonreturn valve with a higher opening pressure, upon action of the pressure medium in an operating state of low pressure medium preliminary pressure, the pressure medium stream is guided via the first nonreturn valve having a low opening pressure while the second nonreturn valve having a higher opening pressure remains closed. Since the first nonreturn valve opens at a low differential pressure, rapid opening of said nonreturn valve is achieved at a low pressure medium preliminary pressure, and, given a low flow resistance, a large throughflow of pressure medium is achieved at a high adjustment speed.

The first nonreturn valve preferably has a small transmitting cross section. The transmitting cross section can be reduced here for optimization purposes in such a manner that, in the operating state at a low pressure medium preliminary pressure, constriction of the supply of pressure medium, which has an adverse effect on the adjustment speed, by the first nonreturn valve is still reliably avoided. As a result, the blocking body of the first nonreturn valve can be designed with the smallest possible transmitting cross section and with the smallest possible mass and smallest possible inertia, thus enabling particularly short reaction times of the first nonreturn valve to be achieved upon opening and blocking of the pressure medium inflow connection.

In this manner, for example in the hot empty running phase or during the hot starting of the engine, when there is a very low pressure medium level in the pressure medium system, supply of the pressure medium during an adjustment operation can take place with short reaction times and optimized adjustment speed via the open, first nonreturn valve with a small transmitting cross section.

If, as the pressure medium preliminary pressure in the pressure medium inflow connection rises, the higher pressure medium preliminary pressure (differential pressure) required for opening the second nonreturn valve is achieved, the second nonreturn valve automatically opens and the pressure medium is supplied simultaneously via both nonreturn valves which are connected in parallel. As a result, when the transmitting cross section in the pressure medium inflow connection is increased, the throughflow rate of pressure medium is increased.

The opening pressure of the second nonreturn valve can be set in such a manner that, as the pressure medium preliminary pressure in the pressure medium inflow connection rises, an adverse effect on the adjustment speed due to a constricting action of the first nonreturn valve is still reliably avoided by the second nonreturn valve being opened. An optimum setting is achieved if the opening pressure of the second nonreturn valve corresponds to the pressure medium pressure (differential pressure) in the pressure medium inflow connection, at which swinging back of the blades in the pressure spaces is reduced to an extent such that the first nonreturn valve is open permanently. This firstly prevents too premature an opening of the second nonreturn valve at a low pressure medium preliminary pressure, with the consequence of delayed reaction times when opening and blocking the pressure medium inflow connection and, secondly, ensures opening of the second nonreturn valve in good time in order to avoid a constricting action when operated separately. As a result, for a rapid adjustment, an optimized pressure medium stream can be achieved in parallel operation with a high pressure medium preliminary pressure. This permits optimum adjustment dynamics, for example, in high-speed operation in the hot or cold state of the engine.

BRIEF DESCRIPTION OF THE DRAWINGS

Further features of the invention emerge from the description below and from the drawings in which an exemplary embodiment of the invention is illustrated in simplified form. In the drawings.

DETAILED DESCRIPTION OF THE DRAWINGS

Figure 1:
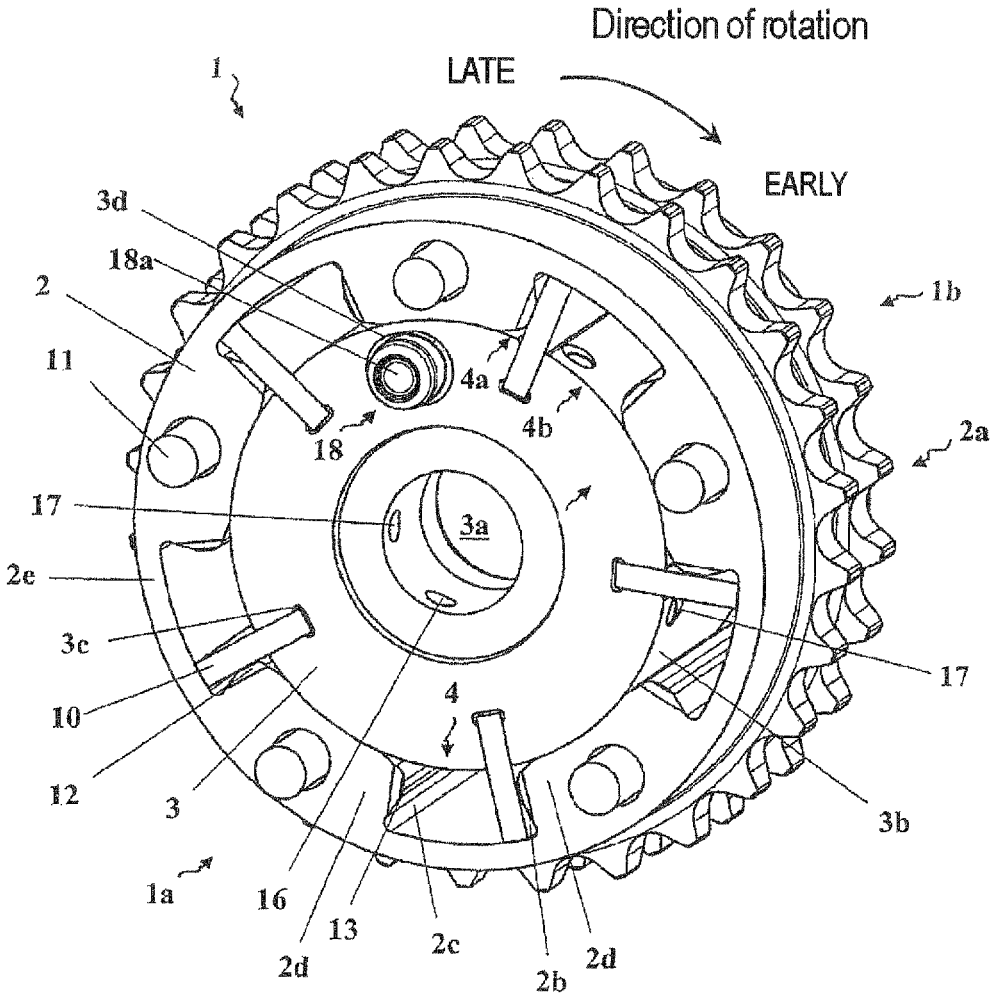
FIG. 1 shows a perspective partial side view of the camshaft adjustment device.

FIG. 1 shows, in a perspective illustration, a hydraulic camshaft adjustment device 1 without a front cover from the side 1*a* facing away from the engine. The camshaft adjustment device 1 has a driving wheel 2 mounted on an output part 3 in a manner rotatable with respect thereto. The driving wheel can be driven via an engagement point 2*a*, a sprocket (illustrated by way of example) which is connected in a rotationally fixed manner to the driving wheel 2 and on the toothing of which a chain driven by a crankshaft (not illustrated) can engage. However, it is also conceivable for the driving wheel 2 to be driven via a belt drive or geared drive. The output part 3 is designed as an impeller wheel and is connected via a central holder 3*a* to a camshaft (not illustrated) in a rotationally fixed manner, for example by means of a screw connection or weld connection. Five blades 10 are formed on the output part 3, said blades being distributed symmetrically over the circumference and extending in the radial direction. Starting from the outer circumference 3*b*, the output part 3 has axially extending blade grooves 3*c* which form radial depressions and in which the blades 10 are arranged connected in a rotationally fixed manner to the output part 3. On that side 1*a* of the camshaft adjustment device 1 which faces away from the engine and on that side 1*b* of same which faces the engine, a respective side cover (not illustrated) is arranged on each of the side surfaces of the driving wheel 2 and is fixed to the latter in a rotationally fixed manner via five fastening screws 11. Five pressure spaces 4 which are arranged symmetrically with respect to one another in the circumferential direction are provided in the driving wheel 2. The pressure spaces are each bound in the circumferential direction to two substantially radially extending, mutually opposite boundary walls 2*b*, 2*c* of adjacent projections 2*d* of the driving wheel 2. In the radial direction, the pressure spaces 4 are each bound radially on the outside by a circumferential wall 2*e* of the driving wheel 2 and radially on the inside by the outer circumference 3*b* of the output part 3. One of the blades 10 projects into each of the pressure spaces 4, the blades 10 being designed in such a manner that they both bear against the circumferential wall 2*e* and can be placed against the boundary walls 2*b*, 2*c* of the projections 2*d*. Each of the blades 10 divides the respective pressure space 4 into two pressure chambers 4*a*, 4*b* operating counter to each other.

The driving wheel 2 is arranged rotatably within a defined angular range with respect to the output part 3. The angular range is limited in one direction of rotation by the blades 10 coming to bear against a late stop 12 formed on the boundary wall 2*h* of the pressure space 4. The angular range in the other direction of rotation is delimited analogously by the blades 10 coming to bear against the early stop 13 formed on the opposite boundary wall 2*c* of the pressure space. FIG. 1 shows the camshaft adjustment device 1 in the maximum late position in which the blades 10 are positioned against the late stop 12. In order to avoid high loads upon the blades 10 being fixed in that region of the output part 3 which is weakened by the axial bore 3*d*, the two blades 10 arranged adjacent to the axial bore 3*d* are moved into an open space when the maximum early or late position is reached and do not strike against the respective boundary walls 2*b*, 2*c*.

By means of one group of pressure chambers 4*a*, 4*b* being acted upon by pressure medium and the other group of pressure chambers 4*a*, 4*b* being relieved of pressure, the angle phase position of the driving wheel 2 relative to the output part 3 can be varied in the direction of rotation of the camshaft adjustment device 1 toward earlier control times (opening and closing times) of the gas exchange valves (not illustrated) or counter to the direction of rotation of the camshaft adjustment device 1 toward later control times. By means of both groups of pressure chambers 4*a*, 4*b* being acted upon by pressure medium, the phase position of the driving wheel 2 and output part 3 relative to each other can be kept constant.

In order to supply pressure medium to or to remove pressure medium from the pressure chambers 4*a*, 4*b*, a pressure medium system is provided comprising a pressure medium pump 14, a tank 15, a regulating device 5 designed as a hydraulic control valve and the pressure medium connections 16, 17. The lubricating oil of the internal combustion engine is customarily used as the hydraulic pressure medium.

Output part 3 and driving wheel 2 can be coupled mechanically via a locking unit 18. The locking unit 18 has a locking bolt 18*a* which is arranged in an axially displaceable manner in an axial bore 3*d* in the output part 3 which locking bolt, in the locked state on the interior of the side cover (not illustrated), the interior facing the output part 3, can engage in a complementarily designed recess. In order to transfer the locking bolt 18*a* from the locked state into the unlocked state, provision is made for the recess to be acted upon with pressure medium. As a result, the locking bolt 18*a* is forced back into the axial bore counter to the force of the spring element, and therefore the coupling between the driving wheel 2 and output part 3 is canceled. The recess is acted upon by pressure medium via the pressure medium connection 16 between the control valve and the pressure chambers 4*a*.

Figure 2:
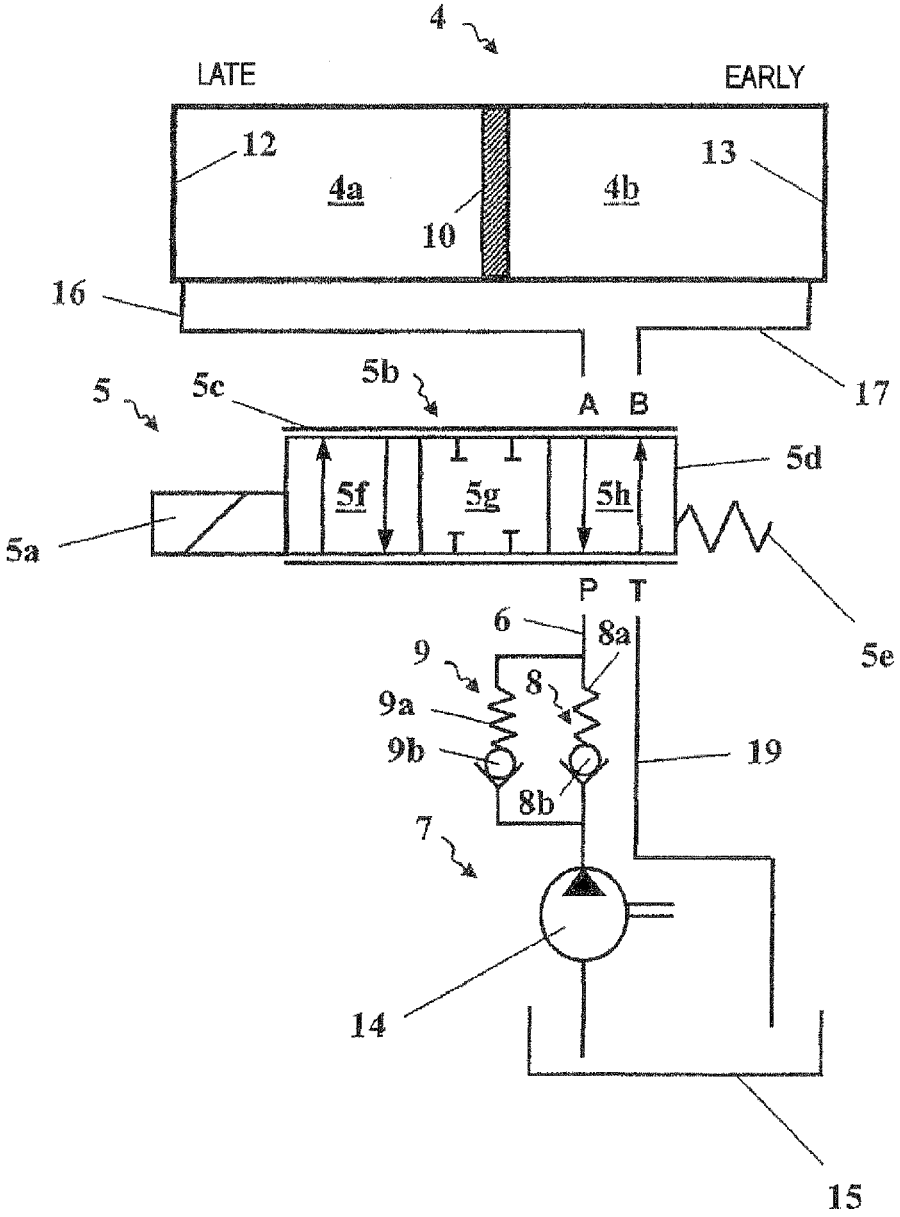
FIG. 2 shows a simplified schematic illustration of the construction of the pressure medium system of the camshaft adjustment device.

FIG. 2 shows the construction of the pressure medium system of the camshaft adjustment device 1 in a highly schematic form by way of example in a hydraulic diagram. A cross section is indicated there through one of the five pressure spaces 4 which are each divided by a blade 10 into a first pressure chamber 4*a* and a second pressure chamber 4*b*. Pressure medium is supplied to and removed from the groups of pressure chambers 4*a*, 4*b* in each case via separate pressure medium connections 16, 17 between said pressure chambers and the regulating device 5 which is designed as a control valve. Provision is made here for the control valve to regulate the pressure medium streams to and from the first and second pressure chambers 4*a*, 4*b*. Two connections A, B connect the control valve to the pressure chambers 4*a*, 4*b*. A first working connection A communicates with the pressure medium connection 16 via which the group of the first pressure chamber 4*a* is supplied with pressure medium. The second working connection B communicates with the pressure medium connection 17 via which the group of second pressure chambers 4*b* is supplied with pressure medium. The control valve is connected to a pressure medium supply device 7 via an inflow connection P. For this purpose, a pressure medium inflow connection 6 is provided connecting the control valve to the pressure medium supply device 7. The pressure medium supply device 7 consists of a pressure medium pump 14, which permanently makes a pressure medium stream available to the camshaft adjustment device 1, and of a pressure medium reservoir designed as a tank 15. The pressure medium can flow into the tank 15 via an outflow connection T which communicates directly with a pressure medium outflow connection 19. The connections P and T can be connected to the oil circuit of the internal combustion engine, for example to the cylinder head gallery, the oil pressure of said oil circuit being dependent on the engine speed and the oil temperature. The connection P then enables pressure medium to be supplied to the camshaft adjustment device 1 from the oil circuit of the engine while the oil which is displaced in the camshaft adjustment device 1 can flow back again via the connection T into the oil circuit of the engine.

The control valve, which can be designed as a plug-in valve or as a central valve consists of an electric actuating unit 5*a* and a hydraulic section 5*b*. The hydraulic section 5*b* has a valve housing 5*c* and an axially displaceable control piston 5*d*. The control piston 5*d* can be displaced axially in the valve housing 5*c* as a function of the electric energization of the electric actuating unit 5*a*. The spring force of a valve spring 5*e*, which acts in the opposite direction, permits the control piston 5*d* to be reset. By means of axial displacement of the control piston 5*d*, the working connections A, B can be connected either to the inflow connection P, to the outflow connection T or to neither thereof. In the control piston 5*d*, which is indicated schematically in FIG. 2, the internal connections of the control valve connections are illustrated symbolically for three switching positions 5*f*, 5*g*, 5*h*.

In order to displace the control times (opening and closing) of the gas exchange valves (not illustrated) toward earlier control times, the first working connection A is connected to the inflow connection P and the second working connection B is connected to the outflow connection T in the advanced position 5*f* of the control valve. By this means, the group of the first pressure chambers 4*a* is acted upon with pressure medium via the pressure medium connection 16. At the same time, pressure medium passes out of the group of the second pressure chambers 4*b* via the pressure medium connection 17 to the control valve and is ejected via the outflow connection T into the tank 15. By means of the pressure difference produced between the two groups of pressure chambers 4*a*, 4*b*, the blades 10 can execute swinging movements in the pressure spaces in a manner corresponding to the alternating torques acting on the camshaft. Since a higher pressure medium pressure prevails in the group of the first pressure chambers 4*a* than in the group of the second pressure chambers 4*b*, the swinging angle is smaller in the late direction than in the early direction. As a result, the blades 10 are displaced into periodic swinging movements in the direction of the early stop 13, resulting in a rotational movement of the output part 3 relative to the driving wheel 2 in the early direction. Adjustment toward later control times in the trailing position 5*h* is achieved analogously. In this case, the second working connection B is connected to the inflow connection P and the first working connection A is connected to the outflow connection T. By means of the group of the second pressure chambers 4*b* being acted upon with pressure medium via the pressure medium connection 17 and with pressure medium being simultaneously ejected from the group of the first pressure chambers 4*a* via the pressure medium connection 16 and via the outflow connection T into the tank 15, a higher pressure medium pressure is generated in the group of the second pressure chambers 4*b* than in the group of the first pressure chambers 4*a*. As a result, the swinging angle of the blades 10 is smaller in the early direction than in the late direction. The blades 10 are thereby displaced into periodic swinging movements in the direction of the late stop 12 and a rotational movement of the output part 3 relative to the driving wheel 2 in the late direction is achieved. Adjustment in the early direction takes place counter to the frictional moments acting on the camshaft, while, upon adjustment in the late direction, the frictional moments acting on the camshaft assist the adjustment operation. In order to keep the control times constant, the supply of pressure medium to all of the pressure chambers 4*a*, 4*b* is suppressed (switching position 5*g*). As a result, the blades 10 are hydraulically clamped within the respective pressure spaces 4, and a rotational movement of the output part 3 relative to the driving wheel 2 is prevented.

In the advanced position 5*f*, the pressure medium inflow connection 6 is connected in terms of pressure medium to the group of the first pressure chambers 4*a* via the inflow connection P and via the working connection A of the control valve. Analogously, in the trailing position 5*h*, the pressure medium inflow connection 6 and the group of the second pressure chambers 4*b* are connected to each other via the inflow connection P and via the working connection B of the control valve.

The pressure medium inflow connection 6 between the control valve and pressure medium supply device 7 contains a first nonreturn valve 8 and a second nonreturn valve 9, which is connected parallel to the latter, via which nonreturn valves the pressure medium inflow connection 6 can be blocked in the direction of the pressure medium supply device 7.

Since, upon action of a pressure medium, the nonreturn valves 8, 9 permit the passage of the pressure medium in the transmitting direction only when the respective opening pressure, i.e. the differential pressure required in each case upstream and downstream of the nonreturn valves 8, 9 for opening purposes, is exceeded, during an adjustment operation both in the advanced position and in the trailing position of the control valve in the pressure medium inflow connection 6, pressure medium can flow only in the direction of the group of the first pressure chambers 4*a* or in the direction of the group of the second pressure chambers 4*b*. If the pressure falls below the differential pressure required in each case for opening purposes, the nonreturn valves 8, 9 each automatically close and block the passage of the pressure medium in the direction of the pressure medium supply device 7 directly in the pressure medium inflow connection 6. As a result, during an adjustment operation, flow of the pressure medium back out of the pressure medium inflow connection 6 into the pressure medium supply device 7 is reliably prevented.

Upon action of a pressure medium in the operating state of low pressure medium preliminary pressure, the pressure medium stream is guided in the transmitting direction via the first nonreturn valve 8 which has a low opening pressure, while the second nonreturn valve 9, which has a higher opening pressure, is closed. In this case, the first nonreturn valve 8 opens at a very small opening pressure. As a result, during the adjustment operation, when the blades 10 swing in the adjustment direction at low differential pressure and small flow resistance, pressure medium can be guided rapidly under short reaction times into the pressure chambers 4*a*, 4*b* which are to be filled. At the same time, when the blades swing back in the pressure spaces 4 counter to the adjustment direction and when the pressure drops below the differential pressure required for opening purposes, the pressure medium is prevented from flowing back by means of rapid blocking of the passage of the pressure medium in the direction of the pressure medium supply device 7.

When the transmitting cross section is small, the first nonreturn valve 8 is designed with a blocking body 8*b* of low mass and low inertia, thus achieving particularly short reaction times in order to open and block the pressure medium inflow connection 6.

In this manner, at low engine speeds and high pressure medium temperatures, if the pressure medium preliminary pressure provided by the pressure medium supply device 7 lies at a very low level, for example in the "hot empty running phase" of the engine in the engine speed range of approx. 600 rpm to approx. 900 rpm and at a pressure medium temperature of approx. 140° C., optimized high adjustment speeds are made possible.

As the pressure medium preliminary pressure in the pressure medium inflow connection 6 rises, the flow resistance in the pressure medium flow connection in the first nonreturn valve 8 increases and, when the differential pressure required for opening the second nonreturn valve 9 is achieved, said nonreturn valve opens automatically. In the case of higher pressure medium preliminary pressure, the pressure medium is then supplied simultaneously via both nonreturn valves 8, 9 which are connected in parallel. In the parallel operation, in contrast to operation separately, the transmitting cross section in the pressure medium inflow connection 6 is increased. As a result, during an adjustment operation at a high pressure medium preliminary pressure, a larger pressure medium stream is guided via the pressure medium inflow connection 6 into the pressure chambers 4*a*, 4*b* to be filled and the adjustment speed can be increased.

The opening pressure of the second nonreturn valve 9 is set corresponding to a pressure medium preliminary pressure (differential pressure) in the pressure medium inflow connection 6, at which, as the engine speed rises, the first nonreturn valve 8 is permanently open. An excess pressure in the pressure medium inflow connection 6, which excess pressure is generated by the blades 10 swinging back in the pressure spaces 4, then no longer has any effect. In this case, the second nonreturn valve 9 opens at a pressure medium preliminary pressure (differential pressure) prevailing in the pressure medium inflow connection 6, in which case a constriction, which has an adverse effect on the adjustment speed, of the supply of pressure medium is reliably prevented by the small transmitting cross section at the first nonreturn valve 8. In this manner, as the engine speed rises, in parallel operation with the two nonreturn valves 8, 9 open, an optimized high pressure medium stream in the pressure medium inflow connection 6 with optimum adjustment dynamics is ensured.

At an optimized opening pressure, the second nonreturn valve 9 opens in the hot state of the engine, for example at a pressure medium temperature of approx. 140° C. and an engine speed of approx. 1700 rpm.

In the cold state of the engine at low pressure medium temperatures, the pressure medium preliminary pressure (differential pressure) required in the pressure medium inflow connection in order to open the second nonreturn valve is already achieved at very low engine speeds because of the high viscosity and density of the pressure medium. This means that, during an adjustment operation even at low pressure medium temperatures, in the case of cold starting of the engine or at a high-speed engine operation in a cold state, in parallel operation with the two nonreturn valves 8, 9 open, an optimized high pressure medium stream is available in the pressure medium inflow connection 6.

The first and the second nonreturn valves 8, 9 are each designed with a blocking body 8*b*, 9*b* which is loaded in the blocking direction by the spring force of a valve spring 8*a*, 9*a* and hermetically seals the pressure medium inflow connection in the blocked direction toward the pressure medium supply device 7. In this case, the valve spring 8*a* of the first nonreturn valve 8 has a small spring force. As a result, said nonreturn valve opens at a low opening pressure. The valve spring 9*a* of the second nonreturn valve 9 is designed with a greater spring force, as the result of which a greater differential pressure is required for opening same in the pressure medium inflow connection 6.

LIST OF DESIGNATIONS

1 Camshaft adjustment device
1*a* Side facing away from the engine
1*b* Side facing the engine
2 Driving wheel
2*a* Engagement point
2*b* Boundary wall
2*c* Boundary wall
2*d* Projection
2*e* Circumferential wall
3 Output part
3*a* Holder
3*b* Outer circumference
3*c* Blade groove
3*d* Axial bore
4 Pressure space
4*a* First pressure chamber
4*b* Second pressure chamber
5 Regulating device
5*a* Actuating unit
5*b* Hydraulic section
5*c* Valve housing
5*d* Control piston
5*e* Valve spring
5*f* Advanced position
5*g* Switching position
5*h* Trailing position
6 Pressure medium inflow connection
7 Pressure medium supply device
8 Nonreturn valve
8*a* Valve spring
8*b* Blocking body
9 Nonreturn valve
9*a* Valve spring
9*b* Blocking body
10 Blade
11 Fastening screw
12 Late stop
13 Early stop
14 Pressure medium pump
15 Tank
16 Pressure medium connection
17 Pressure medium connection
18 Locking unit
18*a* Locking bolt
19 Pressure medium outflow connection
A Working connection
B Working connection
P Inflow connection
T Outflow connection

The invention claimed is:

1. A camshaft adjustment device, comprising:

a driving wheel; a output part arranged rotatably relative to the driving wheel; a regulating device; a pressure medium supply device; at least one pressure medium inflow connection formed between the regulating device and the pressure medium supply device; and at least two nonreturn valves disposed in the at least one pressure medium inflow connection, the driving wheel and output part being operatively connected by at least one pressure space which can be acted upon by a pressure medium, and the regulating device regulating a supply of the pressure medium to the pressure space and a removal of the pressure medium from the pressure space, wherein a passage of the pressure medium through the nonreturn valves, which are connected parallel to each other, in the pressure medium inflow connection can be blocked in a direction of the pressure medium supply device; and wherein the nonreturn valves include a first nonreturn valve and a second nonreturn valve, the first nonreturn valve has an opening pressure which is lower than an opening pressure of the second nonreturn valve.

2. The camshaft adjustment device as claimed in claim 1, wherein the first nonreturn valve has a small transmitting cross-section.

3. The camshaft adjustment device as claimed in claim 1, wherein the opening pressure of the second nonreturn valve corresponds to a pressure medium pressure at which the first nonreturn valve is permanently open upon actuation by pressure medium.

4. The camshaft adjustment device as claimed in claim 1, wherein the nonreturn valves are arranged so that the supply of pressure medium, in an operating state with a high pressure medium pressure and a high pressure medium temperature, simultaneously guideable by both the first nonreturn valve and the second nonreturn valve.

* * * * *

UNITED STATES PATENT AND TRADEMARK OFFICE

CERTIFICATE OF CORRECTION

PATENT NO. : 8,590,498 B2
APPLICATION NO. : 13/057636
DATED : November 26, 2013
INVENTOR(S) : Busse et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 482 days.

Signed and Sealed this
Twenty-second Day of September, 2015

Michelle K. Lee

Michelle K. Lee
*Director of the United States Patent and Trademark Office*